US005326234A

United States Patent [19]

Versaw et al.

[11] Patent Number: 5,326,234

[45] Date of Patent: Jul. 5, 1994

[54] FLUID DRIVEN PUMP

[75] Inventors: William F. Versaw, Pittsburgh; Charles W. Taylor; Mitchell H. Jordan, both of Greensburg, all of Pa.

[73] Assignee: Versa-Matic Tool, Inc., Export, Pa.

[21] Appl. No.: 18,807

[22] Filed: Feb. 17, 1993

[51] Int. Cl.[5] ..... F04B 35/00

[52] U.S. Cl. ..... 417/393; 417/395

[58] Field of Search ..... 417/393, 395, 396, 397, 417/404

[56] References Cited

U.S. PATENT DOCUMENTS

| | | | |
|---|---|---|---|
| 2,944,528 | 7/1960 | Phinney . | |
| 3,071,118 | 1/1963 | Wilden . | |
| 3,176,719 | 4/1965 | Nord et al. . | |
| 3,454,214 | 7/1969 | Milleron . | |
| 3,635,125 | 1/1972 | Rosen et al. | 91/55 |
| 3,791,768 | 2/1974 | Wanner | 417/395 |
| 3,838,946 | 10/1974 | Schall | 417/395 |
| 4,406,596 | 9/1983 | Budde | 417/393 |
| 4,496,294 | 1/1985 | Frikker | 417/393 X |
| 4,566,867 | 1/1986 | Bazan et al. | 417/393 |
| 4,817,503 | 4/1989 | Yamada | 417/393 |
| 4,854,832 | 8/1989 | Gardner et al. | 417/393 |
| 4,921,408 | 5/1990 | Kvinge et al. | 417/368 |

FOREIGN PATENT DOCUMENTS

| | | | |
|---|---|---|---|
| 1172904 | 8/1984 | Canada . | |
| 3940629 | 6/1991 | Fed. Rep. of Germany | 417/393 |

*Primary Examiner*—Louis J. Casaregola
*Assistant Examiner*—Alfred Basichas
*Attorney, Agent, or Firm*—Kirkpatrick & Lockhart

[57] ABSTRACT

A fluid driven pump includes an inlet, at least one expansion chamber for expanding upon introduction of fluid thereinto and contracting upon removal of fluid therefrom, a pumping chamber adjacent the expansion chamber for pumping in response to the expansion chamber's expansion and contraction, and an outlet for outletting pressurized fluid from the expansion chamber. A control system controls a flow of fluid from the inlet to the expansion chamber and a flow of pressurized fluid from the expansion chamber to the outlet. The outlet includes structure for gradually reducing the pressure of the fluid within a portion of the outlet to reduce blockage of the outlet due to freezing.

21 Claims, 5 Drawing Sheets

FLUID DRIVEN PUMP

BACKGROUND OF THE INVENTION

1. Field of the Invention

The present invention relates to devices useful for pumping fluids and semisolids. More particularly, the present invention relates to devices such as double diaphragm pumps which are driven by a fluid.

2. Description of the Invention's Background

Various devices have been developed which are useful for pumping fluids or semisolids and which are driven by some type of a fluid such as air. Many of such devices which use air, compress the air during a portion of the pumping cycle and then exhaust the compressed air to atmospheric pressure. If there is water vapor in the air, i.e., humidity, and it is not removed from the compressed air before it enters the pump, the cooling effect of polytropic, adiabatic expansion of the compressed air as it is exhausted can cause the water to freeze. As an example, if the relative humidity of the air is 40 percent and a volume of that air is compressed to one half of its original volume, the relative humidity of the air becomes 80 percent because the volume of the water does not significantly change. The temperature drop caused by adiabatic expansion of the compressed air from a pressure of 4.5 bar (approximately 65 psi) to atmospheric pressure, at a room temperature of 68 degrees Fahrenheit, is about 120 degrees Fahrenheit. Thus when the air undergoes rapid adiabatic expansion, i.e., expansion without the addition of heat, the temperature of the air drops quickly and the moisture in the air freezes. When the moisture freezes it tends to build up in and block an exhaust passage of an air driven pump, and it eventually can completely shut off the exhaust passage, preventing operation of the pump. The temperature reduction can be so great that not only will the water vapor in the exhaust air freeze, but also the housing of the pump can become so cold that water vapor in the atmosphere will condense and freeze on the exterior of the pump.

Various air driven pumps have accordingly been designed which include some means for reducing the freezing of water vapor entrained in the air which drives the pump, or for reducing blockage of an exhaust passage of the pump due to freezing of the water vapor. For example, U.S. Pat. No. 4,566,867 to Bazan, et. al. discloses a pneumatically operated reciprocating three way valve of a double diaphragm pump, which includes a mechanism to reduce ice in the valve. As shown in FIG. 3, a needle valve allows the controlled bleeding of high pressure air from an internal high pressure chamber to an internal low pressure chamber. The high pressure air is disclosed as furnishing internal energy, i.e. velocity, to the exhaust air to mechanically displace ice as it forms. U.S. Pat. No. 4,921,408 to Kvinge et al. discloses a silencing system for an air operated pump which is asserted to also eliminate icing of the pump at higher cycle rates and humidities. Exhaust air exiting from an air cylinder is mixed with relatively warm ambient air in an air flow inducer such that they form a mixed flow in an exit stream. The exit stream has a substantially lower velocity and higher temperature than the air leaving the exhaust in the exhaust nozzle block, and thus icing is assertedly reduced. U.S. Pat. No. 2,944,528 to Phinney discloses an air distributing valve which includes a reed which is oscillable in an exhaust port of the valve. A cavity adjacent the exhaust port has a coating, such as silicon resin or Teflon®, which tends to prevent ice from adhering thereto. The reed and the coating are disclosed as cooperating to prevent ice formation.

U.S. Pat. No. 4,406,596 to Budde discloses a double diaphragm pump which includes a mechanism for equalizing the pressure between two air chambers. The pressure equalization reduces the pressure blow off that occurs in the exhaust of air from the pump, and thus is stated to reduce the danger that ice will form at the air exhaust. U.S. Pat. No. 3,176,719 to Nord, et al. discloses a four-way valve which attempts to minimize ice formation in exhaust ports by eliminating impediments in the exhaust passages on which ice may form. Also, resilient washers are provided in the exhaust ports and these washers are contacted by closures during the valve cycle to break loose ice which may form on the washers. U.S. Pat. No. 3,635,125 to Rosen, et al. discloses a double-acting hydraulic pump and air motor which includes a muffler. Ice accumulation in exhaust spaces of the muffler is avoided because an outer plate of the muffler is flexible, and when ice accumulates in the spaces the resultant increase in exhaust pressure causes flexure of the plate which causes blowout or purging of the ice from the spaces.

The devices disclosed in the patents cited above each utilize either some type of air mixing or some type of moving element to attempt to reduce ice formation therein. The ice reduction mechanism of each of the disclosed devices thus has the disadvantage that it adds to the overall complexity of the device's design by adding either additional air flow paths, additional moving parts, or both to the device, which can contribute to greater manufacturing costs and repair downtime for the device.

OBJECTS AND SUMMARY OF THE INVENTION

It is an object of the present invention to provide an improved fluid driven pump which is capable of reducing blockage of an outlet thereof, which blockage is due to freezing of the fluid or a portion of the fluid.

A further object of the present invention is to provide a fluid driven pump which provides for reduced blockage in a relatively simple manner.

Another object of the present invention is to provide a fluid driven pump which is relatively easy to maintain.

It is a further object of the present invention to provide a fluid driven pump which is relatively easy to manufacture.

The above objects as well as other objects not specifically enumerated are accomplished by a fluid driven pump in accordance with the present invention. The fluid driven pump of the present invention includes an inlet for inletting fluid, an expanding chamber for expanding upon introduction of fluid thereinto and contracting upon removal of fluid therefrom, a pumping chamber positioned adjacent the expanding chamber for pumping in response to expansion and contraction of the expanding chamber, an outlet for outletting pressurized fluid, and a control system for controlling a flow of fluid from the inlet to the expanding chamber and a flow of pressurized fluid from the expanding chamber to the outlet. The outlet includes means for gradually reducing the pressure of the fluid within a section of the outlet to reduce blockage of the outlet due to freezing.

The objects of the present invention are also accomplished by a fluid driven pump which includes an inlet for inletting fluid, an expanding chamber for expanding upon introduction of fluid thereinto and contracting upon removal of fluid therefrom, a pumping chamber positioned adjacent the expanding chamber for pumping in response to expansion and contraction of the expanding chamber, an outlet for outletting pressurized fluid, and a control system for controlling a flow of fluid from the inlet means to the expanding chamber and a flow of pressurized fluid from the expanding chamber to the outlet. The outlet includes a primary section which is tapered for gradually increasing the cross-sectional area of the outlet. The outlet may alternatively include a primary section which includes at least one tapered wall to gradually decrease the pressure of fluid within the primary section, and a secondary section which widens more rapidly to more rapidly decrease the pressure of fluid within the secondary section, to reduce blockage of the outlet due to freezing.

BRIEF DESCRIPTION OF THE DRAWINGS

The preferred embodiment of the present invention will be described in greater detail with reference to the accompanying drawings, wherein like members bear like reference numerals and wherein.

DETAILED DESCRIPTION OF THE DRAWINGS

Figure 1:
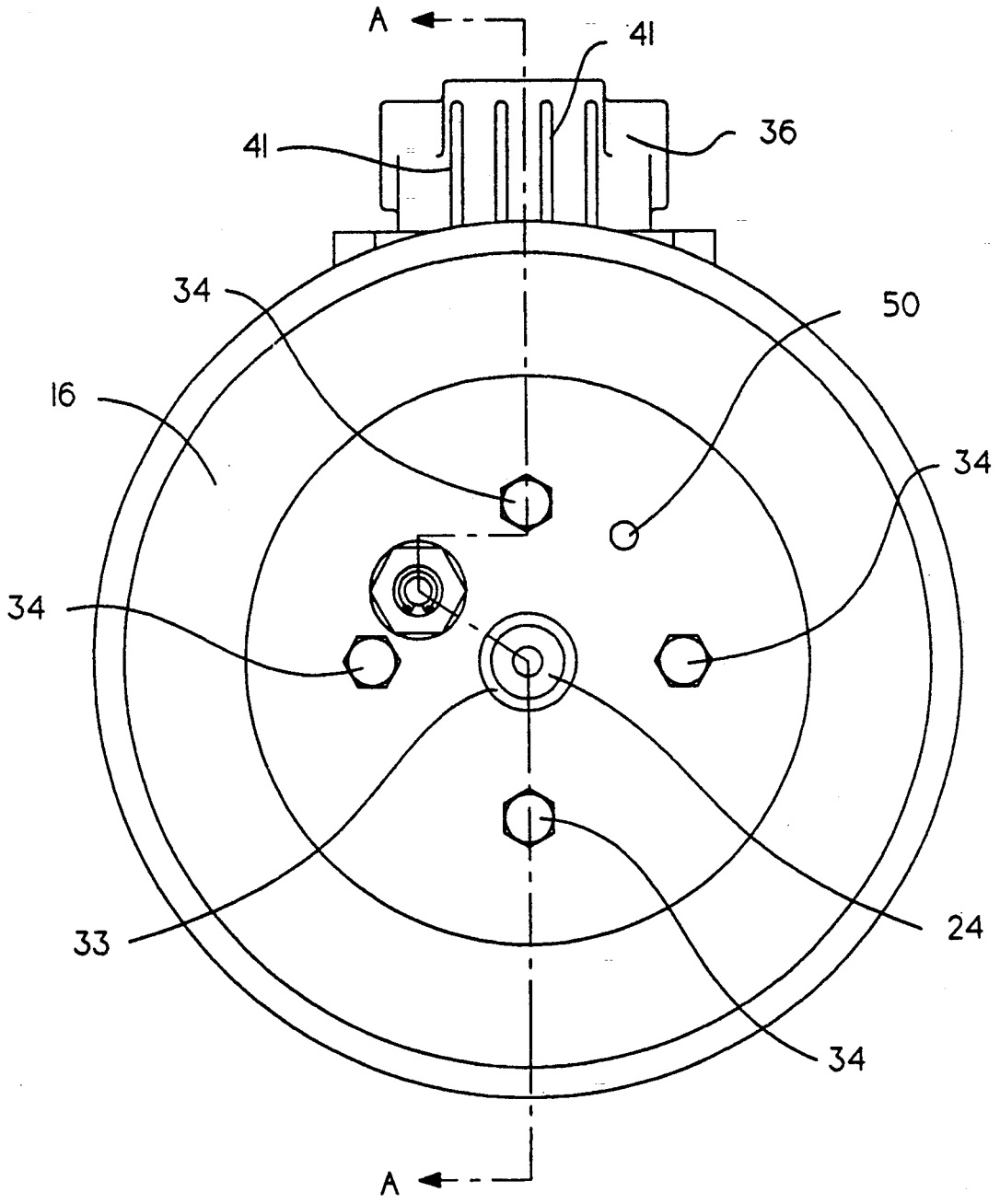
FIG. 1 is an end view of a fluid driven pump of the present invention with a pumping chamber and diaphragm of a first expansion chamber removed.
Figure 2:
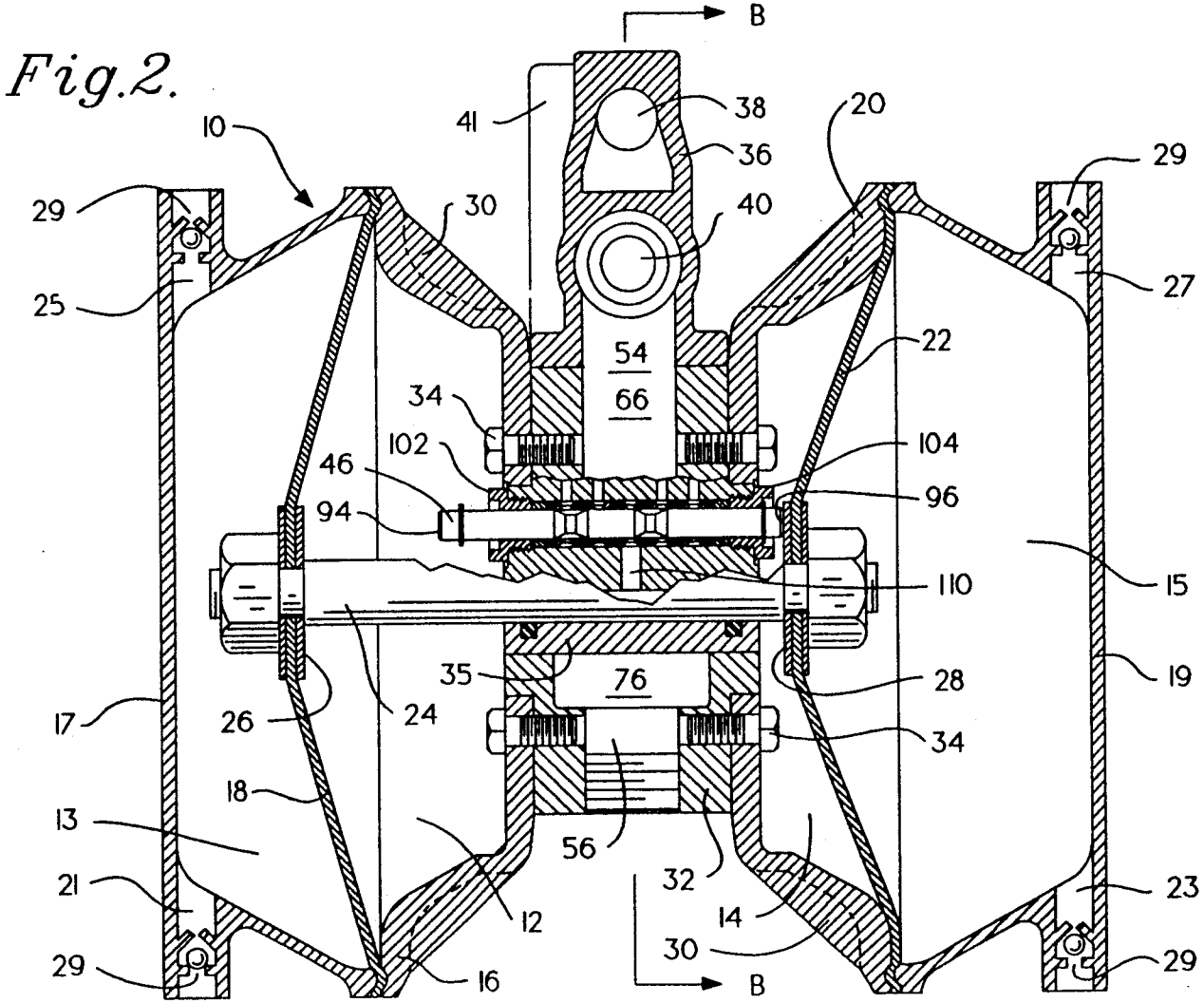
FIG. 2 is a cross sectional view along line A—A of FIG. 1 including the pumping chamber and diaphragm which are removed in FIG. 1.

With reference to FIGS. 1–6, a fluid driven pump in accordance with an embodiment of the present invention includes a double diaphragm air driven pump 10 having a first expansion chamber 12 and a second expansion chamber 14. As shown in FIG. 2, the first chamber 12 is airtight, and is bounded by a housing 16 and a first diaphragm 18. The second chamber 14 is also airtight and is bounded by a housing 20 and a second diaphragm 22. The two diaphragms 18, 22 are interconnected by a shaft 24, which is connected to the first diaphragm 18 by a first flange 26 and to the second diaphragm 22 by a second flange 28. Accordingly, as one of the chambers 12, 14 expands due to outward movement of its respective diaphragm 18, 22, the other of the chambers 12, 14 contracts due to inward movement of its respective diaphragm 18, 22. Each of the housings 16, 20 has located thereon a plurality of fins 30, and, as is shown in FIGS. 1 and 2, is attached to a center block 32 by means of four bolts 34.

Each of the housings 16, 20 is attached to a mating housing 17, 19 which forms pumping chambers 13, 15 operating in conjunction with diaphragms 18, 22, respectively. Each pumping chamber 13, 15 has an inlet 21, 23 and an outlet 25, 27 respectively, which each include a one way valve 29.

Figure 5:
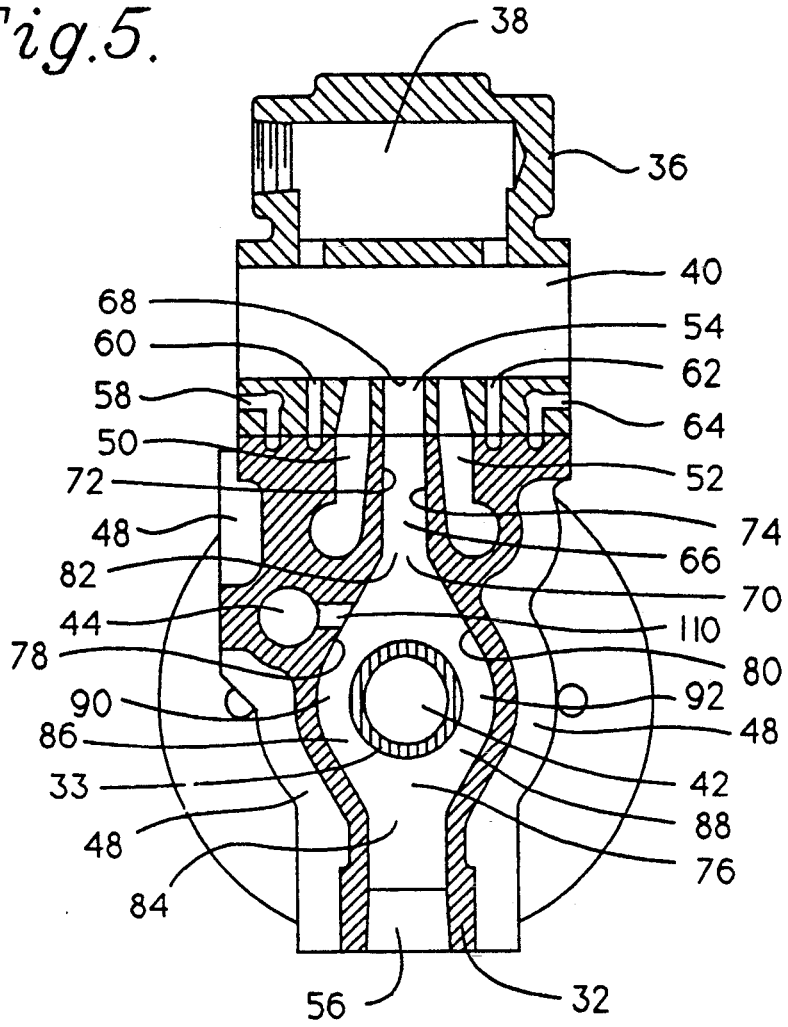
FIG. 5 is a cross sectional view of a center block, a bearing, and a spool valve housing of the fluid driven pump of FIG. 1, taken along line B—B of FIG. 2.

As is shown in FIGS. 1, 2 and 5, the center block 32 has attached thereto a spool valve housing 36 which includes an inlet 38 and a spool valve chamber 40, and which has a plurality of fins 41 located thereon. The center block 32 includes a hole 42 therethrough to accommodate a bearing 33 and the shaft 24, and a hole 44 therethrough to accommodate a pilot shaft 46, as will be explained hereinbelow. The center block 32 also has a plurality of vertically spaced sets of fins 48 located thereon, one set of which is shown in FIG. 5.

The center block 32 and the spool valve housing 36 together form a number of passageways. These passageways include a fluid line 50 which runs between the spool valve chamber 40 and the first expansion chamber 12, a fluid line 52 which runs between the spool valve chamber 40 and the second expansion chamber 14, and an outlet 54 which runs from the spool valve chamber 40 to an exhaust opening 56. The center block 32 and the spool valve housing 36 also together form fluid lines 58, 60, 62, 64 which run between the spool valve housing 40 and the hole 44 for the pilot shaft 46. The fluid lines 58 and 64 are shown more completely in FIG. 3A.

The outlet 54 includes a primary section 66 which runs from an upstream end 68 at the spool valve chamber 40 to a downstream end 70. The primary section 66 is bounded by two walls 72, 74 which are tapered such that the primary section 66 gradually widens from the upstream end 68 to the downstream end 70. The walls 72, 74 each include a taper substantially in the range from two to five degrees, and preferably of about two degrees. Thus, if a line were drawn down the length of and bisecting the outlet 54 in FIG. 5, each of the walls 72, 74 would be angled by about two degrees from the line. An upper wall and a lower wall, which are not angled relative to the line, also bound the primary section 66 above and below the primary section 66.

The outlet 54 further includes a secondary section 76 which is bounded by two walls 78, 80 and which initially widens much more rapidly than the primary section 66. The walls 78, 80 each taper as much as 30 degrees initially from an upstream end 82 of the secondary section 76, which is adjacent the downstream end 70 of the primary section 66, then approximate an arc of a circle which has its center at the center of the hole 42, and then taper inwardly by as much as 30 degrees until they reach a downstream end 84 of the secondary section 76. When the pump 10 is fully assembled, the secondary section 76 splits into two branches 86, 88 around the bearing 33 and the shaft 24, which branches 86, 88 have midpoints 90, 92, respectively.

The cross sectional area of the primary section 66 gradually increases from its upstream end 68 to its downstream end 70. For example, in a preferred embodiment of the pump 10, the area of the primary section 66 at the upstream end 68 is 0.3658 square inches (2.36 $cm^2$), the area at the downstream end 70 is 0.6662 square inches (4.30 $cm^2$), and the length of the primary section 66 is approximately 2.07 inches (5.26 cm). The cross sectional area of the primary section 66 of the preferred embodiment thus increases by about 0.30 square inches (1.9 $cm^2$) over a distance of approximately 2.1 inches (5.3 cm). In contrast, the cross sectional area of the secondary section 76 increases rather rapidly. In the preferred embodiment, the cross sectional area of the upstream end of the secondary section 76 is 0.6662 square inches (4.30 $cm^2$), the cross sectional area of each branch 86, 88 at the midpoint 90, 92 thereof is 0.7457 square inches (4.81 $cm^2$), i.e., the total cross sectional area of the secondary section 76 at the midpoints 90, 92 is 1.4914 square inches (9.62 $cm^2$), and the distance between the upstream end 82 and a line connecting the midpoints 90, 92 is approximately 1.75 inches (4.45 cm). The cross sectional area of the secondary section 76 of the preferred embodiment thus increases by about 0.83 square inches (5.3 $cm^2$) over a distance of about 1.8 inches (4.5 cm). From the midpoints 90, 92 to the downstream end 84 of the secondary section 76, the cross sectional area of the secondary section 76 decreases, to about 0.6675 square inches (4.31 $cm^2$) at the downstream end 84 in the preferred embodiment.

Figure 3A:
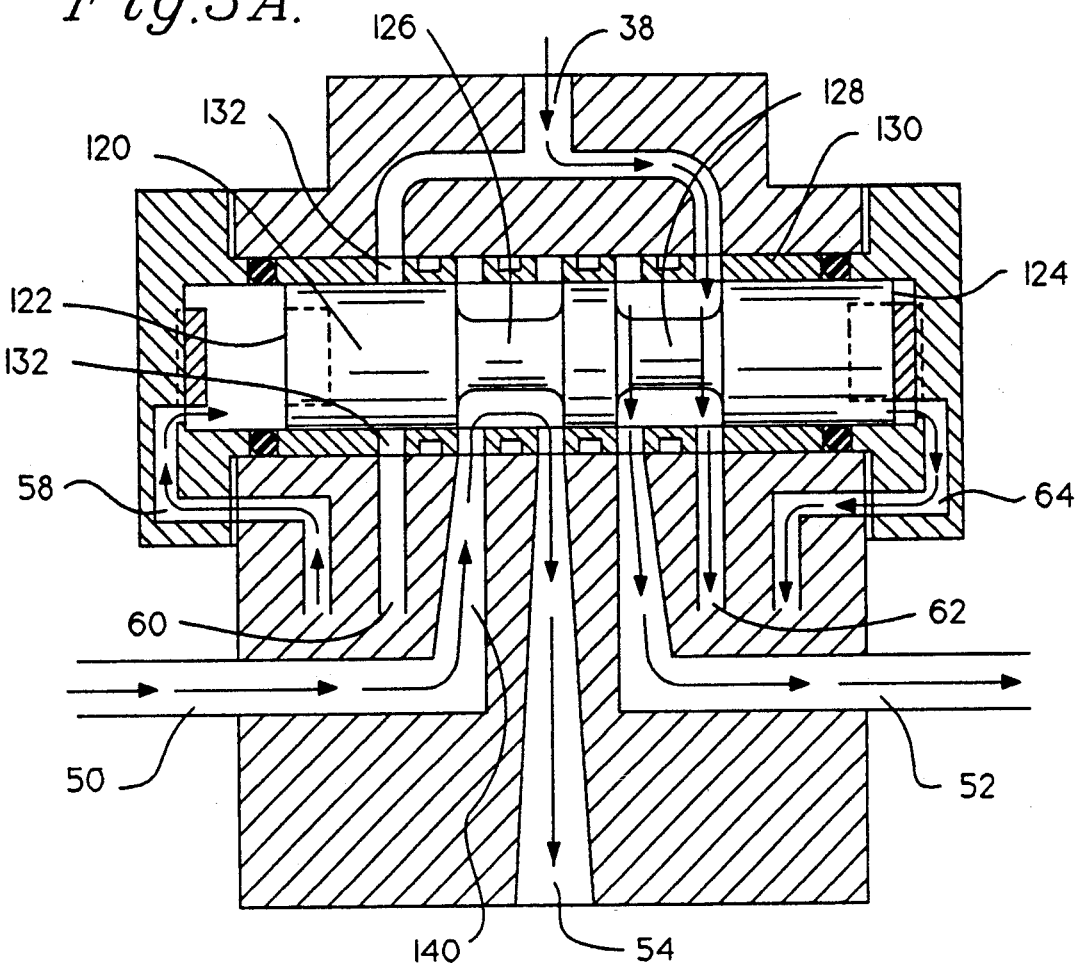
FIG. 3A is a schematic view of a spool valve of a fluid control system of the present invention in a second position.
Figure 3B:
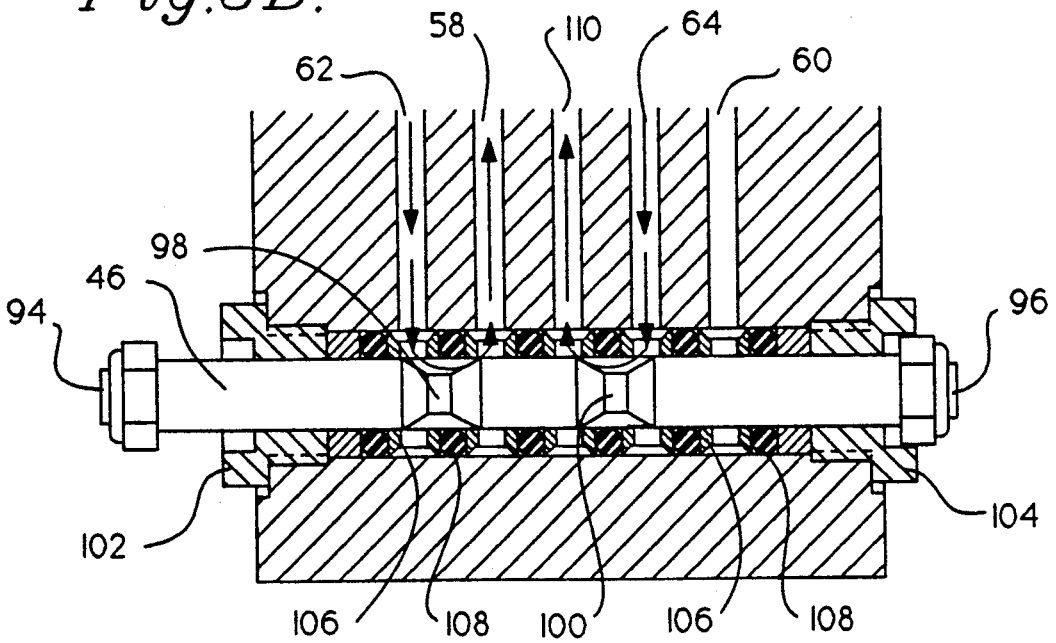
FIG. 3B is a schematic view of a pilot shaft of the control system of the present invention in a first position.

As shown in FIGS. 2 and 3B, the pilot shaft 46 which extends through the hole 44 in the center block 32 includes a first end 94, a second end 96, and two reduced diameter areas 98, 100. The pilot shaft 46 is slidably supported in the hole 44 by a pair of end caps 102, 104, a plurality of rings 106, and a plurality of O-rings 108 which vertically space the rings 106 apart. During assembly, the end cap 104 is first screwed into the hole 44 and the pilot shaft 46 is placed in the hole 44. Thereafter, O-rings 108 and rings 106 are alternately dropped into the hole 44 around the pilot shaft 46. The end cap 102 is then screwed into hole 44 such that it compresses the O-rings 108 between all of the rings 106 and the end cap 104, such that the O-rings seal against the rings 106, the inside of the hole 44, and the pilot shaft 46 (except where an O-ring 108 is adjacent to one of the reduced diameter areas 98, 100 of the pilot shaft 46). When assembled, each of the rings 106 is located adjacent to one of the fluid lines 58, 60, 62, 64, or an exhaust line 110 which runs between the hole 44 and secondary section 76 of the outlet 54.

Figure 6:
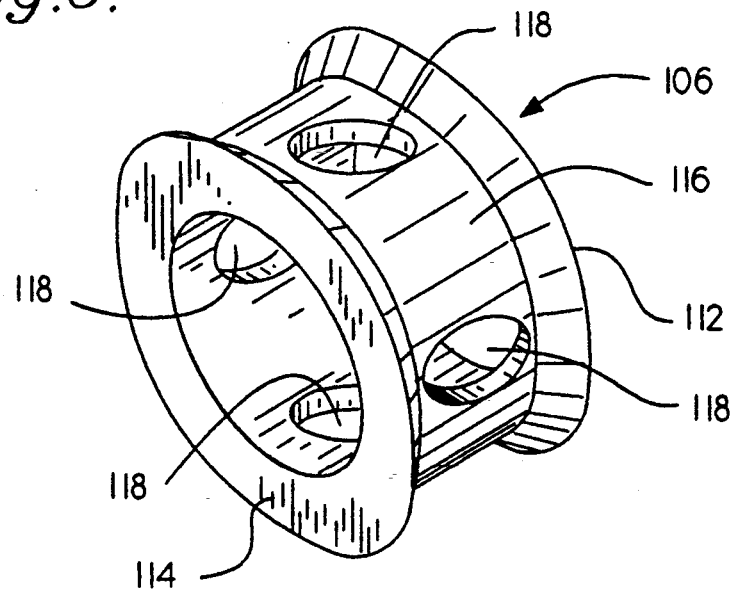
FIG. 6 is a perspective view of a ring which extends around the pilot shaft of FIGS. 3B and 4B.

As seen in FIG. 6, each of the rings 106 includes an upper flange 112, a lower flange 114, a reduced diameter portion 116, and a plurality of holes 118 extending through the reduced diameter portion 116. The rings 106 allow fluid communication to be made from the interior of the hole 44 to the fluid and exhaust lines 58, 60, 62, 64, 110, and need only be machined within fairly large tolerances since compression of the O-rings 108 provides a seal against the upper and lower flanges 112, 114 of the ring 106, the inner wall of the hole 44, and the pilot shaft 46. If the rings 106 were not used, a hollow cylinder having holes in a side wall thereof would need to be precision machined so that its outer diameter would fit tightly within the hole 44 and its inner diameter would fit tightly around the pilot shaft 46 while still allowing the pilot shaft 46 to slide therein.

As is shown in FIG. 3A, a spool valve 120 rests slidably within the spool valve chamber 40, and includes a first end 122, a second end 124, and reduced diameter portions 126, 128. The spool valve 120 fits within a hollow cylinder 130 which has a plurality of holes 132 therein which are in fluid communication with the inlet 38, the fluid lines 50, 52, 60, and 62, and the outlet 54.

The structure and operation of the double diaphragm air driven pump 10 will now be explained. The spool valve 120, the pilot shaft 46, and the various fluid lines 50, 52, 58, 60, 62, 64 comprise a fluid control system which, as will be described hereinbelow, acts to alternately expand the first and second expansion chambers 12, 14. Thus as the first chamber 12 expands and the first diaphragm 18 necessarily moves outwardly, the second diaphragm 22 is pulled inwardly by the shaft 24 and the second chamber 14 contracts. As the first chamber 12 expands, the pumping chamber 13 contracts due to movement of the first diaphragm 18, and forces the fluid or semisolid therein out of the pumping chamber outlet 25 through a one way valve 29. Similarly, as the second chamber 14 contracts, the adjacent pumping chamber 15 expands and pulls fluid or semisolid into the pumping chamber 15 through a one way valve 29 in the inlet 23 thereof. When the control system reverses the process and begins to expand the second chamber 14 and thus contract the first chamber 12, the pumping chamber 15 adjacent the second chamber 14 empties and the pumping chamber 13 adjacent the first chamber 12 fills. In this manner, the pump 10 acts to pump a fluid or semisolid along two flow paths.

With reference to FIGS. 2 through 4B, the operation of the control system will now be explained. The spool valve 120 is movable between a first position, as seen in FIG. 4A, and a second position, as seen in FIG. 3A. In the first position of the spool valve 120, the reduced diameter portion 126 of the spool valve 120 is situated such that the inlet 38 is connected to the fluid line 50 and the fluid line 52 is connected to the outlet 54. The first expansion chamber 12 is thus in fluid communication with the inlet 38 and expands due to the pressure of air supplied by the inlet 38. The second expansion chamber 14 is in fluid communication with the outlet 54 and is thus able to contract because pressurized air which was compressed into the second chamber 14 can exhaust to the atmosphere through the outlet 54.

Figure 4A:
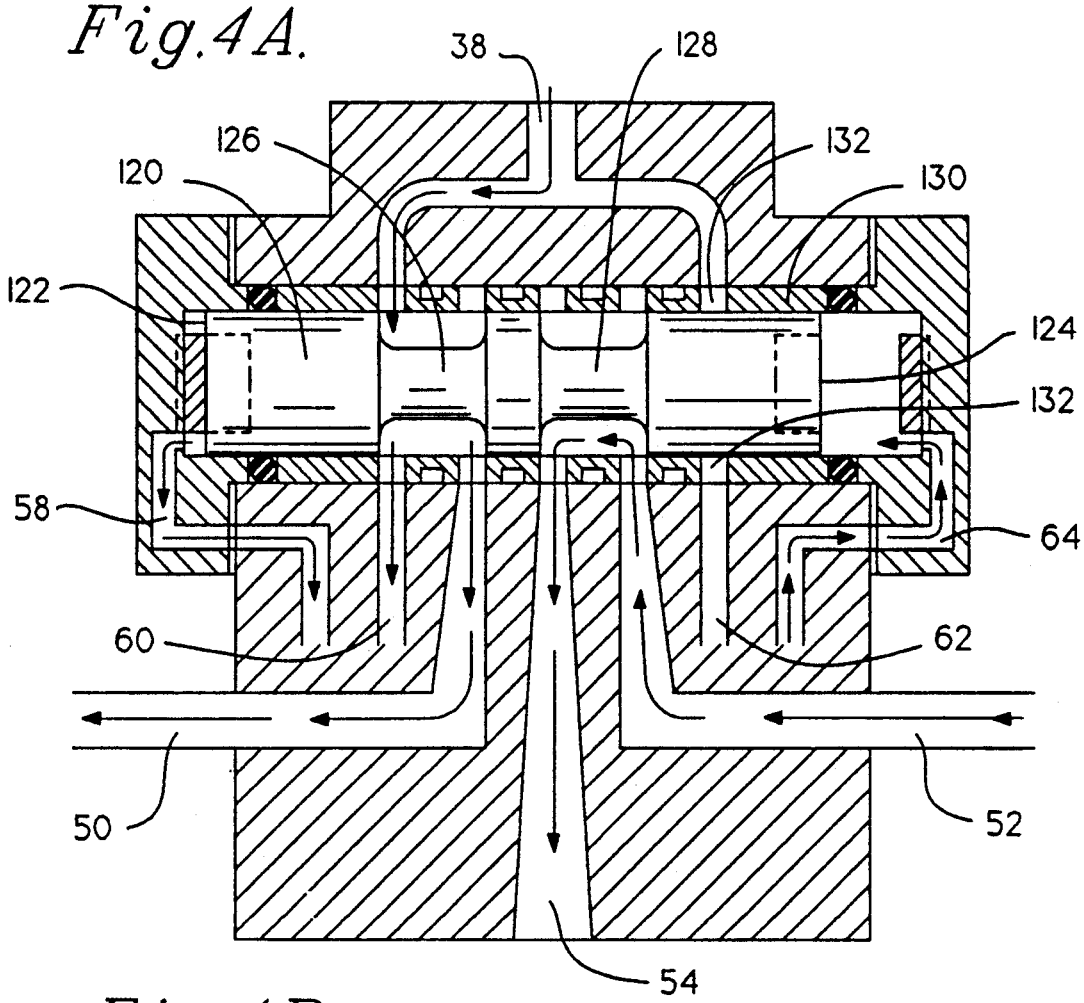
FIG. 4A is a schematic view of the spool valve of FIG. 3A in a first position.
Figure 4B:
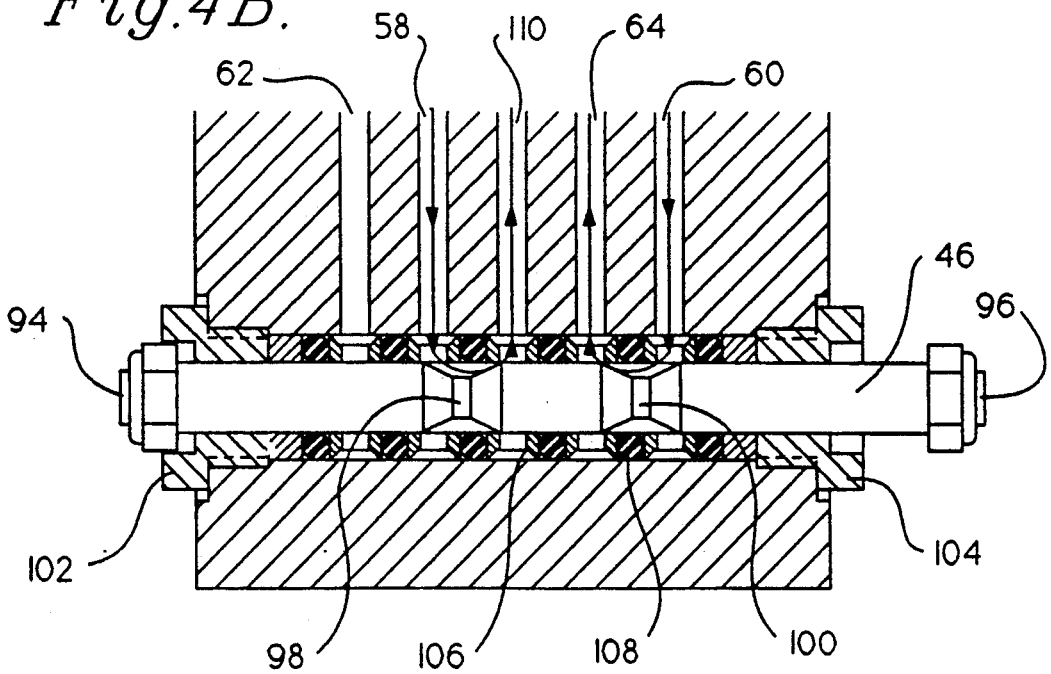
FIG. 4B is a schematic view of the pilot shaft of FIG. 3B in a second position.

The spool valve 120 will remain in the first position shown in FIG. 4A as long as the pilot shaft 46 remains in the second position shown in FIG. 4B. In the second position the pilot shaft 46 connects the fluid line 60, which is open to the inlet 38, to the fluid line 64 through the reduced diameter portion 100, and connects the fluid line 58 to the exhaust line 110 through the reduced diameter portion 98. The second end 124 of the spool valve 120 is thus in fluid communication with the inlet 38 and the first end 122 of the spool valve 120 is thus in fluid communication with the outlet 54, such that the difference in pressures on the second and first ends 124, 122 biases the spool valve 120 into the first position thereof.

However, as shown in FIG. 2, as the first diaphragm 18 moves outwardly the second diaphragm 22 moves inwardly, until the second flange 28 on the shaft 24 contacts the second end 96 of the pilot shaft 46 and moves the pilot shaft 46 from the second position thereof to a first position thereof. The first position of the pilot shaft 46 is shown in FIG. 3B, and in the first position the fluid line 62, which is now open to the inlet 38, is connected to the fluid line 58 through the reduced diameter portion 98, and the fluid line 64 is connected to the exhaust line 110 through the reduced diameter portion 100. Thus the first end 122 of the spool valve 120 is in fluid communication with the inlet 38, and the second end 124 of the spool valve is in fluid communication with the outlet 54, and the difference in pressures on the first and second ends 122, 124 biases the spool valve 120 into the first position thereof shown in FIG. 3A.

When the spool valve 120 is in the first position of FIG. 3A, the fluid line 52 is connected to the inlet 38 and the fluid line 50 is connected to the outlet 54. The second chamber 14 is thus in fluid communication with the inlet 38 and begins to expand in response to the pressure of air from the inlet 38, while the first chamber 12 is in fluid communication with the outlet 54 and thus is able to contract because pressurized air which was compressed into the first chamber 12 can exhaust to the atmosphere through the outlet 54. Expansion of the second chamber 14 and contraction of the first chamber 12 continues until the first flange 26 on the shaft 24 contacts the first end 94 of the pilot shaft 46 and moves it to the second position thereof shown in FIG. 4B. At this point, one complete cycle of the pump 10 has been completed and the cycle starts anew.

Up to this point, it has simply been stated that each of the first and second chambers 12, 14 exhaust compressed air which is contained therein through the outlet 54 as they contract, but this process bears further explanation. Taking the first expansion chamber 12 as a representative example, it should be appreciated that as the expansion chamber 12 is filled with air from the inlet 38 as shown in FIG. 4A, the pressure of the air within the first chamber 12 rapidly rises from atmospheric pressure to between seven and ten times atmospheric pressure, in a preferred embodiment of the pump 10. Then, once the spool valve 120 is moved from the first position shown in FIG. 4A to the second position shown in FIG. 3A, the fluid line 50 is connected to the outlet 54 and the compressed air in the first chamber 12 is free to flow through the fluid line 50 to the outlet 54. As the air from the first chamber 12 moves through the fluid line 50 it is first compressed to a slightly higher pressure in a portion 140 of the fluid line 50, and it is then guided to the outlet 54 through the reduced diameter portion 126.

At this point, as shown in FIG. 5, the compressed air enters the primary section 66 of the outlet 54 through the upstream end 68 thereof, and travels through the primary section 66 to the downstream end 70 thereof. Because the walls 72, 74 of the primary section 66 are gradually tapered and thus the cross sectional area of the primary section 66 gradually increases, the compressed air expands or increases in volume only gradually within the primary section 66. It is estimated that in a preferred embodiment of the pump 10 the compressed air has an expansion rate within the primary section 66 of generally less than ten percent. The temperature drop of the air within the primary section 66 is accordingly lessened, and the reduction in the temperature drop within the primary section 66 tends to reduce blockage which might otherwise occur in the primary section 66 due to freezing of water vapor entrained in the air.

In test runs on a preferred embodiment of the pump 10, the primary section 66 remained opened to the passage of fluid thereby enabling the pump 10 to remain in operation. It is believed that this result occurred for two reasons. First, since the pressure drop within the primary section 66 is greatly lessened, the concomitant temperature drop during adiabatic expansion is greatly lessened. Second, and less importantly, since the pressure drop occurs over the longer length of the primary section 66, there is a greater chance that heat will be added to the air from the center block 32 during the expansion, such that the expansion is no longer a true adiabatic expansion. As the expanding air passes through the downstream end 70 of the primary section 66, it enters the upstream end 82 of the secondary section 76 of the outlet 54. Within the secondary section 76, the air is able to expand more rapidly since the cross sectional area of the secondary section 76 increases more quickly than the cross sectional area of the primary section 66, as detailed above. The secondary section 76 thus lends itself to a more rapid decrease in the pressure, or a more rapid increase in the volume, of the air therein, and thus to a greater decrease in the temperature of the air, although the overall rate of pressure and temperature decrease is slower in the secondary section 76 than if the outlet 54 simply emptied into a large open chamber. To combat a temperature drop in the air within the secondary section 76, the plurality of vertically spaced sets of fins 48 are provided to distribute heat to the secondary section 76 and thus to fluid within the secondary section 76. The fins 30, 41 also help to distribute heat to the fluid, by distributing heat to the first and second chambers 12, 14 and the spool valve 120. Expansion of the air within the secondary section is therefore not a true adiabatic expansion, since heat is added to the fluid as it expands, and the overall temperature drop within the secondary section 76 is reduced such that blockage of the secondary section 76 due to freezing of water vapor entrained in the air is reduced. In test runs done on a preferred embodiment of the pump 10, the secondary section 76 remained opened to the passage of fluid thereby enabling the pump 10 to remain in operation.

As the air moves through the secondary section 76, it is compressed again somewhat as it approaches the downstream end 84 of the secondary section 76, and it then passes through the exhaust opening 56 and a muffler (not shown), after which it passes into the atmosphere and quickly expands to atmospheric pressure. It should be appreciated that the success of the present invention, in reducing blockage of the outlet 54 thereof due to the freezing of water entrained in the compressed exhaust air, is considered to be due both to the design of the primary section 66, wherein the compressed air is allowed to gradually expand and thus gradually decrease its pressure, and due to the fact that the compressed air is allowed to expand in a number of stages as it is outletted. The provision for gradual expansion within the primary section 66 is important in its own right as discussed above, and the provision of a number of expansion stages, including a gradual, generally adiabatic, pressure reduction stage within the primary section 66, a more rapid, nonadiabatic, pressure reduction stage within the secondary section 76, and even the final reduction to atmospheric pressure stage past the exhaust opening 56, is believed to contribute to an overall outlet design which reduces blockage therein and prevents complete blockage thereof due to freezing.

The advantages of the present invention are accordingly believed to arise from both the inclusion of a primary section in which the air pressure is gradually reduced and the air volume is gradually increased, and from the overall provision of a number of expansion or pressure reduction stages in which the air pressure is brought in stages from a pressure of between seven to ten times atmospheric pressure to atmospheric pressure. The prevention of complete blockage of the outlet 54 due to the above measures tends to decrease the pump's down time, and the measures require the use of a relatively small overall portion of the pump. The measures thus tend to increase the pump's cost effectiveness. Due to the use of the above measures, the present invention also has advantages over other devices which attempt to reduce blockage using additional air mixing flow paths and control mechanisms, or additional moving parts, because the present invention is relatively less complex and thus tends to be relatively cost effective to manufacture and maintain.

Advantages of the present invention also arise from the design of the parts surrounding the pilot shaft 46. As stated above, a plurality of rings 106 are used to connect the various fluid and exhaust lines 58, 60, 62, 64, 110 with the hole 44, which rings can be made within fairly broad tolerances due to the sealing effect of the O-rings 108 once they are compressed by the end caps 102, 104. If a hollow metal cylinder were used in place of the rings 106 and the O-rings 108, the cylinder would need to be made within very narrow tolerances to that it would correctly seal within the hole 44. Such a cylinder would not only be much more expensive than the rings 106 and the O-rings 108, it would be much more difficult to place within the hole 44 due to its tight fit therein, and would thus make the pump more time-consuming to assemble.

It is to be understood that, while not shown in the drawings, it is within the scope of the invention to change the path of the outlet 54 within the pump 10, as long as the outlet 54 includes a primary section in which the pressure of the air therein can be gradually decreased. For example, the outlet might be constructed such that it turns 180 degrees as it enters the center block 32, re-enters the spool valve housing 36 above the spool valve chamber 40, and then connects to an exhaust opening which could be constructed in the spool valve housing 36. Such an outlet would include a primary section along some portion thereof which is gradually tapered to allow for gradual expansion of air within the primary section. It should also be understood that a fluid other than air may be used to drive the pump 10, and advantages obtained therefrom.

The principles, a preferred embodiment and the mode of operation of the present invention have been described in the foregoing specification. However, the invention which is intended to be protected is not to be construed as limited to the particular embodiment disclosed. The embodiment is therefore to be regarded as illustrative rather than restrictive. Variations and changes may be made by others without departing from the spirit of the present invention. Accordingly, it is expressly intended that all such equivalents, variations and changes which fall within the spirit and scope of the present invention as defined in the claims be embraced thereby.

What is claimed is:

1. A fluid driven pump, comprising:

inletting means for inletting fluid;

expanding chamber means for expanding upon introduction of fluid thereinto and contracting upon removal of fluid therefrom;

pumping chamber means positioned adjacent said expanding chamber means for pumping in response to expansion and contraction of said expanding chamber means;

outletting means for outletting pressurized fluid; and control means for controlling a flow of fluid from said inletting means to said expanding means, and a flow of pressurized fluid from said expanding means to said outletting means;

wherein said outletting means includes means for gradually reducing the pressure of the fluid within a portion of said outletting means to reduce blockage of said outletting means due to freezing.

2. A fluid driven pump as claimed in claim 1, wherein said gradual pressure reducing means includes means for gradually increasing the cross-sectional area of said outletting means.

3. A fluid driven pump as claimed in claim 1, wherein said pump is a double diaphragm pump and said expanding chamber means includes first and second diaphragm chambers partially bounded by first and second diaphragm means, said control means including means for alternating the flow of fluid from said inletting means to said first and second chambers, and from said first and second chambers to said outletting means, such that when one of said chambers expands the other of said chambers contracts.

4. A fluid driven pump as claimed in claimed 3, wherein said alternating means includes spool valve means for connecting said first chamber to said inletting means and said second chamber to said outletting means when said spool valve means is in a first position, and for connecting said first chamber to said outletting means and said second chamber to said inletting means when said spool valve means is in a second position; and a pilot shaft means for controlling flow of the fluid to move said spool valve means from said first position to said second position in response to inward movement of said second diaphragm means, and to move said spool valve means from said second position to said first position in response to inward movement of said first diaphragm means.

5. A fluid driven pump as claimed in claim 1, further including means for distributing heat through said pump.

6. A fluid driven pump as claimed in claim 5, wherein said heat distributing means includes fin means located on a housing of said pump which surrounds said outletting means, for distributing heat to said outletting means and thus reducing a temperature drop of the fluid in said outletting means.

7. A fluid driven pump as claimed in claim 6, wherein said heat distributing means further includes fin means, located on a housing of said pump which surrounds said expanding chamber means and on a housing of said pump which surrounds spool valve means of said control means, for distributing heat to said expanding chamber means and said spool valve means.

8. A fluid driven pump, comprising:

inletting means for inletting fluid;

expanding chamber means for expanding upon introduction of fluid thereinto and contracting upon removal of fluid therefrom;

pumping chamber means positioned adjacent said expanding chamber means for pumping in response to expansion and contraction of said expanding chamber means;

outletting means for outletting pressurized fluid; and control means for controlling a flow of fluid from said inletting means to said expanding means, and a flow of pressurized fluid from said expanding means to said outletting means;

wherein said outletting means includes a primary section which is tapered for gradually increasing the cross-sectional area of said outletting means.

9. A fluid driven pump as claimed in claim 8, wherein said primary section includes a pair of walls which are each outwardly tapered substantially within the range of two to five degrees.

10. A fluid driven pump as claimed in claim 9, wherein said pump is a double diaphragm pump and said expanding chamber means includes first and second diaphragm chambers partially bounded by first and second diaphragm means, said control means including means for alternating the flow of fluid from said inletting means to said first and second chambers, and from said first and second chambers to said outletting means, such that when one of said chambers expands the other of said chambers contracts.

11. A fluid driven pump as claimed in claimed 10, wherein said alternating means includes spool valve means for connecting said first chamber to said inletting means and said second chamber to said outletting means when said spool valve means is in a first position, and for connecting said first chamber to said outletting means and said second chamber to said inletting means when said spool valve means is in a second position; and a pilot shaft means for controlling flow of the fluid to move said spool valve means from said first position to said second position in response to inward movement of said second diaphragm means, and to move said spool valve means from said second position to said first position in response to inward movement of said first diaphragm means.

12. A fluid driven pump as claimed in claim 8, further including means for distributing heat, said heat distributing means includes fin means located on a housing of said pump which surrounds a secondary section of said outletting means, for distributing heat to said secondary section and thus reducing a temperature drop of the fluid in said secondary section.

13. A fluid driven pump, comprising:

an inlet for connection to a source of fluid;

a first expansion chamber which is expandable upon introduction of fluid into said first expansion chamber and contractable upon removal of fluid therefrom;

a first pumping chamber positioned adjacent said first expansion chamber to pump in response to expansion and contraction of said first expansion chamber;

an outlet; and a fluid control system, said control system being in fluid communication with said inlet, said first expansion chamber, and said outlet, to control a flow of fluid from said inlet to said first expansion chamber, and to control a flow of pressurized fluid from said first expansion chamber to said outlet;

wherein said outlet includes a primary section which includes at least one tapered wall to gradually decrease the pressure of fluid within said primary section, and a secondary section which widens more rapidly to more rapidly decrease the pressure of fluid within said secondary section, to reduce blockage of said outlet due to freezing.

14. A fluid driven pump as claimed in claim 13, wherein said at least one tapered wall includes a pair of walls which are each tapered outwardly substantially in the range of two to five degrees.

15. A fluid driven pump as claimed in claim 13, wherein said pump further includes a housing surrounding said secondary section and a plurality of fins located on said housing to distribute heat through said secondary section.

16. A fluid driven pump as claimed in claim 13, wherein said primary section includes an upstream end in fluid communication with said first expansion chamber and a downstream end, and said secondary section includes an upstream end adjacent to said downstream end of said primary section.

17. A fluid driven pump as claimed in claim 13, wherein said pump includes a second expansion chamber and a second pumping chamber adjacent said second expansion chamber, and wherein said first and second expansion chambers are partially bounded by first and second diaphragms, respectively, which are interconnected by a shaft such that when one of said diaphragms moves outwardly the other of said diaphragms moves inwardly, said control system being in fluid communication with said second expansion chamber and said outlet.

18. A fluid driven pump as claimed in claim 17, wherein said control system includes a spool valve which connects said first expansion chamber to said inlet and said second expansion chamber to said outlet when said spool valve is in a first position, and which connects said first expansion chamber to said outlet and said second expansion chamber to said inlet when said spool valve is in a second position.

19. A fluid driven pump as claimed in claim 18, wherein said control system further includes a pilot shaft which in a first position places a first end of said spool valve in fluid communication with said inlet and a second end of said spool valve in fluid communication with said outlet to bias said spool valve toward said second position of said spool valve, and which in a second position places said second end of said spool valve in fluid communication with said inlet and said first end of said spool valve in fluid communication with said outlet to bias said spool valve to said first position of said spool valve, a second flange on said shaft contacting and moving said pilot shaft to said first position as said second diaphragm moves inwardly, and a first flange on said shaft contacting and moving said pilot shaft to said second position as said first diaphragm moves inwardly.

20. A fluid driven pump as claimed in claim 13, further including:

a first housing surrounding at least a portion of said outlet, and a plurality of first fins located on said first housing to distribute heat to said outlet;

a second housing surrounding at least a portion of said first expansion chamber, and a plurality of second fins located on said second housing to distribute heat to said first expansion chamber; and a third housing surrounding at least a portion of a spool valve of said control system, and a plurality of third fins located on said third housing to distribute heat to said spool valve.

21. A fluid driven pump as claimed in claim 13, wherein said control system includes a spool valve for alternately connecting said first chamber to said inlet and said outlet, and a pilot shaft for fluid control of said spool valve, said pilot shaft being in fluid communication with a plurality of fluid lines through a plurality of rings having holes therethrough, said rings being vertically spaced from one another by O-rings.

* * * * *

UNITED STATES PATENT AND TRADEMARK OFFICE

CERTIFICATE OF CORRECTION

PATENT NO. : 5,326,234

DATED : July 5, 1994

INVENTOR(S) : William F. Versaw, Charles W. Taylor, Mitchell H. Jordan

It is certified that error appears in the above-indentified patent and that said Letters Patent is hereby corrected as shown below:

Col. 9, line 17, delete "to that" and substitute therefor --so that--.

Signed and Sealed this

Thirteenth Day of December, 1994

*Attest:*

*Attesting Officer*

BRUCE LEHMAN

*Commissioner of Patents and Trademarks*